US010865465B2

(12) United States Patent
Sherman et al.

(10) Patent No.: US 10,865,465 B2
(45) Date of Patent: Dec. 15, 2020

(54) DEGRADABLE METAL MATRIX COMPOSITE

(71) Applicant: TERVES, LLC, Euclid, OH (US)

(72) Inventors: Andrew J. Sherman, Mentor, OH (US); Nicholas Farkas, Euclid, OH (US); David Wolf, Euclid, OH (US)

(73) Assignee: Terves, LLC, Euclid, OH (US)

( * ) Notice: Subject to any disclaimer, the term of this patent is extended or adjusted under 35 U.S.C. 154(b) by 237 days.

(21) Appl. No.: 16/045,924

(22) Filed: Jul. 26, 2018

(65) Prior Publication Data

US 2019/0032173 A1 Jan. 31, 2019

Related U.S. Application Data

(60) Provisional application No. 62/537,707, filed on Jul. 27, 2017.

(51) Int. Cl.
*C22C 1/10* (2006.01)
*C22C 29/02* (2006.01)
(Continued)

(52) U.S. Cl.
CPC ..... *C22C 1/1068* (2013.01); *C22C 1/0491* (2013.01); *C22C 1/101* (2013.01); *C22C 1/1036* (2013.01); *C22C 21/00* (2013.01); *C22C 23/00* (2013.01); *C22C 29/02* (2013.01); *C22C 29/06* (2013.01); *C22C 29/12* (2013.01); *C22C 29/14* (2013.01); *C22C 29/16* (2013.01); *C22C 29/18* (2013.01); *C22C 32/0036* (2013.01); *C22C 32/0052* (2013.01); *C22C 32/0057* (2013.01); *C22C 32/0063* (2013.01); *C22C 32/0068* (2013.01); *C22C 32/0073* (2013.01); *C22C 32/0078* (2013.01); *C22C 47/04* (2013.01);
(Continued)

(58) Field of Classification Search
CPC ..... C22C 1/1068; C22C 1/0491; C22C 21/00; C22C 23/00; C22C 29/02
See application file for complete search history.

(56) References Cited

U.S. PATENT DOCUMENTS 3,180,728 A 4/1965 Pryor et al.
3,445,731 A 5/1969 Saeki et al.
(Continued)

FOREIGN PATENT DOCUMENTS

CA 2886988 10/2015
CN 101381829 3/2009
(Continued)

OTHER PUBLICATIONS

National Physical Laboratory, "Bimetallic Corrosion" Crown (C) p. 1-14 (2000).
(Continued)

*Primary Examiner* — Christopher S Kessler
*Assistant Examiner* — Jiangtian Xu
(74) *Attorney, Agent, or Firm* — Ulmer & Berne LLP

(57) ABSTRACT

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations.

20 Claims, 6 Drawing Sheets

(51) Int. Cl.

| | |
|---|---|
| ***C22C 1/04*** | (2006.01) |
| ***C22C 47/04*** | (2006.01) |
| ***C22C 32/00*** | (2006.01) |
| ***C22C 23/00*** | (2006.01) |
| ***C22C 21/00*** | (2006.01) |
| ***C22C 29/06*** | (2006.01) |
| ***C22C 29/18*** | (2006.01) |
| ***C22C 49/04*** | (2006.01) |
| ***C22C 29/16*** | (2006.01) |
| ***C22C 47/12*** | (2006.01) |
| ***C22C 29/14*** | (2006.01) |
| ***C22C 29/12*** | (2006.01) |

(52) U.S. Cl.
CPC ..... *C22C 47/12* (2013.01); *C22C 49/04* (2013.01); *C22C 2001/1073* (2013.01)

(56) References Cited

U.S. PATENT DOCUMENTS 4,264,362 A 4/1981 Serveg et al.
4,655,852 A 4/1987 Rallis
4,875,948 A 10/1989 Vemecker
5,106,702 A 4/1992 Walker et al.
5,240,495 A 8/1993 Dieckmann et al.
5,336,466 A 8/1994 Iba
5,342,576 A 8/1994 Whitehead
5,552,110 A 9/1996 Iba
5,894,007 A 11/1999 Yuan et al.
5,980,602 A 11/1999 Carden
6,036,792 A 3/2000 Chu et al.
6,126,898 A 10/2000 Butler
6,422,314 B1 7/2002 Todd et al.
6,444,316 B1 9/2002 Reddy et al.
6,527,051 B1 3/2003 Reddy et al.
6,554,071 B1 4/2003 Reddy et al.
6,737,385 B2 5/2004 Todd et al.
7,350,582 B2 4/2008 McKeachnie et al.
7,353,879 B2 4/2008 Todd et al.
7,531,020 B2 5/2009 Woodfield et al.
7,647,964 B2 1/2010 Akbar et al.
7,690,436 B2 4/2010 Turley et al.
7,771,547 B2 8/2010 Bieler et al.
7,794,520 B2 9/2010 Murty et al.
7,879,162 B2 2/2011 Pandey
7,999,987 B2 8/2011 Dellinger et al.
8,034,152 B2 10/2011 Westin et al.
8,211,247 B2 7/2012 Marya et al.
8,211,248 B2 7/2012 Marya
8,211,331 B2 7/2012 Jorgensen et al.
8,220,554 B2 7/2012 Jordan et al.
8,230,731 B2 7/2012 Dyer et al.
8,267,177 B1 9/2012 Vogel et al.
8,327,931 B2 12/2012 Agrawal et al.
8,403,037 B2 3/2013 Agrawal et al.
8,413,727 B2 4/2013 Holmes
8,425,651 B2 4/2013 Xu et al.
RE44,385 E 7/2013 Johnson
8,485,265 B2 7/2013 Marya et al.
8,486,329 B2 7/2013 Shikai et al.
8,506,733 B2 8/2013 Enami et al.
8,528,633 B2 9/2013 Agrawal et al.
8,573,295 B2 11/2013 Johnson et al.
8,613,789 B2 12/2013 Han et al.
8,631,876 B2 1/2014 Xu et al.
8,663,401 B2 3/2014 Marya et al.
8,668,762 B2 3/2014 Kim et al.
8,695,684 B2 4/2014 Chen et al.
8,695,714 B2 4/2014 Xu
8,714,268 B2 5/2014 Agrawal et al.
8,723,564 B2 5/2014 Kim et al.
8,746,342 B1 6/2014 Nish et al.
8,776,884 B2 7/2014 Xu
8,789,610 B2 7/2014 Oxford
8,808,423 B2 8/2014 Kim et al.
8,852,363 B2 10/2014 Numano et al.
8,905,147 B2 12/2014 Fripp et al.
8,967,275 B2 3/2015 Crews
9,016,363 B2 4/2015 Xu et al.
9,016,384 B2 4/2015 Xu
9,027,655 B2 5/2015 Xu
9,068,428 B2 6/2015 Mazyar et al.
9,080,439 B2 7/2015 O'Malley
9,101,978 B2 8/2015 Xu
9,181,088 B2 11/2015 Sibuet et al.
9,187,686 B2 11/2015 Crews
9,217,319 B2 12/2015 Frazier et al.
9,227,243 B2 1/2016 Xu et al.
9,243,475 B2 1/2016 Xu
9,309,744 B2 4/2016 Frazier
9,447,482 B2 9/2016 Kim et al.
9,528,343 B2 12/2016 Jordan et al.
9,605,508 B2 3/2017 Xu
9,938,451 B2 4/2018 Crews
10,174,578 B2 1/2019 Walton et al.
2002/0121081 A1 9/2002 Cesaroni et al.
2002/0197181 A1 12/2002 Osawa et al.
2005/0194141 A1 9/2005 Sinclair et al.
2006/0113077 A1 6/2006 Willberg et al.
2006/0131031 A1 6/2006 McKeachnie
2006/0175059 A1 8/2006 Sinclair et al.
2006/0207387 A1 9/2006 Soran et al.
2006/0278405 A1 12/2006 Turley
2007/0181224 A1 8/2007 Marya et al.
2008/0041500 A1 2/2008 Bronfin
2008/0149345 A1 6/2008 Marya et al.
2008/0175744 A1 7/2008 Motegi
2009/0116992 A1 5/2009 Lee
2009/0226340 A1 9/2009 Marya
2010/0119405 A1 5/2010 Okamoto et al.
2010/0161031 A1 6/2010 Papirov et al.
2010/0270031 A1 10/2010 Patel
2010/0304178 A1 12/2010 Dirscherl
2011/0048743 A1 3/2011 Stafford et al.
2011/0067889 A1 3/2011 Marya et al.
2011/0091660 A1 4/2011 Dirscherl
2011/0135530 A1 6/2011 Xu et al.
2011/0221137 A1 9/2011 Obi et al.
2011/0236249 A1 9/2011 Kim et al.
2012/0080189 A1 4/2012 Marya et al.
2012/0097384 A1 4/2012 Valencia et al.
2012/0103135 A1 5/2012 Xu et al.
2012/0125642 A1 5/2012 Chenault
2012/0156087 A1 6/2012 Kawabata
2012/0177905 A1 7/2012 Seals et al.
2012/0190593 A1 7/2012 Soane et al.
2012/0273229 A1 11/2012 Xu et al.
2012/0318513 A1 12/2012 Mazyar et al.
2013/0022816 A1 1/2013 Smith et al.
2013/0029886 A1 1/2013 Mazyar et al.
2013/0032357 A1 2/2013 Mazyar et al.
2013/0043041 A1 2/2013 McCoy et al.
2013/0047785 A1 2/2013 Xu
2013/0056215 A1 3/2013 Crews
2013/0068411 A1 3/2013 Forde et al.
2013/0112429 A1 5/2013 Crews
2013/0133897 A1 5/2013 Bailhly et al.
2013/0160992 A1 6/2013 Agrawal et al.
2013/0168257 A1 7/2013 Mazyar et al.
2013/0199800 A1 8/2013 Kellner et al.
2013/0209308 A1 8/2013 Mazyar et al.
2013/0261735 A1 10/2013 Pacetti et al.
2013/0048289 A1 12/2013 Mazyar
2014/0018489 A1 1/2014 Johnson
2014/0027128 A1 1/2014 Johnson
2014/0060834 A1 3/2014 Quintero
2014/0093417 A1 4/2014 Liu
2014/0124216 A1 5/2014 Fripp et al.
2014/0190705 A1 7/2014 Fripp
2014/0196889 A1 7/2014 Jordan et al.
2014/0202284 A1 7/2014 Kim
2014/0202708 A1 7/2014 Jacob et al.
2014/0219861 A1 8/2014 Han

(56) References Cited

U.S. PATENT DOCUMENTS

| | | | | |
|---|---|---|---|---|
| 2014/0224477 | A1 | 8/2014 | Wiese et al. | |
| 2014/0236284 | A1 | 8/2014 | Stinson | |
| 2014/0271333 | A1 | 9/2014 | Kim et al. | |
| 2014/0286810 | A1 | 9/2014 | Marya | |
| 2014/0305627 | A1 | 10/2014 | Manke | |
| 2015/0102179 | A1 | 4/2015 | McHenry et al. | |
| 2015/0240337 | A1 | 8/2015 | Sherman et al. | |
| 2015/0247376 | A1 | 9/2015 | Tolman | |
| 2015/0299838 | A1* | 10/2015 | Doud | C22F 1/06 420/409 |
| 2015/0354311 | A1 | 12/2015 | Okura et al. | |
| 2016/0024619 | A1 | 1/2016 | Wilks | |
| 2016/0201425 | A1 | 7/2016 | Walton | |
| 2016/0201427 | A1 | 7/2016 | Fripp | |
| 2016/0201435 | A1 | 7/2016 | Fripp et al. | |
| 2016/0230494 | A1 | 8/2016 | Fripp et al. | |
| 2016/0251934 | A1 | 9/2016 | Walton | |
| 2016/0265091 | A1 | 9/2016 | Walton et al. | |

FOREIGN PATENT DOCUMENTS

| | | |
|---|---|---|
| CN | 102517489 | 6/2012 |
| CN | 102796928 | 11/2012 |
| CN | 103343271 | 10/2013 |
| CN | 103602865 | 2/2014 |
| CN | 103898384 | 7/2014 |
| CN | 104004950 | 8/2014 |
| CN | 104651691 | 5/2015 |
| EP | 0470599 | 2/1998 |
| EP | 2088217 | 8/2009 |
| JP | 2008266734 | 11/2008 |
| JP | 2012197491 | 10/2012 |
| JP | 2013019030 | 1/2013 |
| JP | 2014043601 | 3/2014 |
| KR | 20130023707 | 3/2013 |
| WO | 1990002655 | 3/1990 |
| WO | 1992013978 | 8/1992 |
| WO | 9857347 | 12/1998 |
| WO | 1999027146 | 6/1999 |
| WO | 2009055354 | 4/2009 |
| WO | 2009093420 | 7/2009 |
| WO | 2012091984 | 7/2012 |
| WO | 2013019410 | 2/2013 |
| WO | 2013019421 | 2/2013 |
| WO | 2013109287 | 7/2013 |
| WO | 2013122712 | 8/2013 |
| WO | 201354634 | 10/2013 |
| WO | 2014100141 | 6/2014 |
| WO | 2014113058 | 7/2014 |
| WO | 2015171126 | 11/2015 |
| WO | 2016024974 | 2/2016 |
| WO | 2016032758 | 3/2016 |
| WO | 2016032761 | 3/2016 |
| WO | 2016036371 | 3/2016 |

OTHER PUBLICATIONS

Saravanan et al., "Fabrication and characterization of pure magnesium-30 vol SiCP particle composite", Material Science and Eng., vol. 276, pp. 108-116 (2000).

Song et al., Texture evolution and mechanical properties of AZ31B magnesium alloy sheets processed by repeated unidirectional bending, Journal of Alloys and Compounds, vol. 489, pp. 475-481 (2010).

Blawert et al., "Magnesium secondary alloys: Alloy design for magnesium alloys with improved tolerance limits against impurities", Corrosion Science, vol. 52, No. 7, pp. 2452-2468 (Jul. 1, 2010).

Wang et al., "Effect of Ni on microstructures and mechanical properties of AZ1 02 magnesium alloys" Zhuzao Foundry, Shenyang Zhuzao Yanjiusuo, vol. 62, No. 1, pp. 315-318 (Jan. 1, 2013).

Kim et al., "Effect of aluminum on the corrosions characteristics of Mg—4Ni—xAl alloys", Corrosion, vol. 59, No. 3, pp. 228-237 (Jan. 1, 2003).

Unsworth et al., "A new magnesium alloy system", Light Metal Age, vol. 37, No. 7-8., pp. 29-32 (Jan. 1, 1979).

Geng et al., "Enhanced age-hardening response of Mg—Zn alloys via Co additions", Scripta Materialia, vol. 64, No. 6, pp. 506-509 (Mar. 1, 2011).

Zhu et al., "Microstructure and mechanical properties of Mg6ZnCuO. 6Zr (wt.%) alloys", Journal of Alloys and Compounds, vol. 509, No. 8, pp. 3526-3531 (Dec. 22, 2010).

International Search Authority, International Search Report and Written Opinion for PCT/GB2015/052169 (dated Feb. 17, 2016).

Search and Examination Report for GB 1413327.6 (dated Jan. 21, 2015).

Magnesium Elektron Test Report (Mar. 8, 2005).

New England Fishery Management Counsel, "Fishery Management Plan for American Lobster Amendment 3" (Jul. 1989).

Emly, E.F., "Principles of Magnesium Technology" Pergamon Press, Oxford (1966).

Shaw, "Corrosion Resistance of Magnesium Alloys", ASM Handbook, vol. 13A, pp. 692-696 (2003).

Hanawalt et al., "Corrosion studies of magnesium and its alloys", Metals Technology, Technical Paper 1353 (1941).

The American Foundry Society, Magnesium alloys, casting source directory 8208, available at www.afsinc.org/files/magnes.pdf.

Rokhlin, "Magnesium alloys containing rare earth metals structure and properties", Advances in Metallic Alloys, vol. 3, Taylor & Francis (2003).

Ghali, "Corrosion Resistance of Aluminum and Magnesium Alloys" pp. 382-389, Wiley Publishing (2010).

Kim et al., "High Mechanical Strengths of Mg—Ni—Y and Mg—Cu Amorphous Alloys with Significant Supercooled Liquid Region", Materials Transactions, vol. 31, No. 11, pp. 929-934 (1990).

Tekumalla et al., "Mehcanical Properties of Magnesium-Rare Earth Alloy Systems", Metals, vol. 5, pp. 1-39 (2014).

Ye et al., "Review of recent studies in magnesium matrix composites", Journal of Material Science, vol. 39, pp. 6153-6171 (2004).

Hassan et al., "Development of a novel magnesium-copper based composite with improved mechanical properties", Materials Research Bulletin, vol. 37, pp. 377-389 (2002).

Ye et al., "Microstructure and tensile properties of Ti6A14V/AM60B magnesium matrix composite", Journal of Alloys and Composites, vol. 402, pp. 162-169 (2005).

Kumar et al., "Mechanical and Tribological Behavior of Particulate Reinforced Aluminum metal Matrix Composite", Journal of Minerals & Materials Characterization and Engineering, vol. 10, pp. 59-91 (2011).

Majumdar, "Micromechanics of Discontinuously Reinforced MMCs", Engineering Mechanics and Analysis of Metal-Matrix Composites, vol. 21, pp. 395-406.

Metals Handbook, Desk Edition, edited by J.R. Davis, published by ASM International, pp. 559-574 (1998).

Scharf et al., "Corrosion of AX 91 Secondary Magnesiunm Alloy", Advanced Engineering Materials, vol. 7, No. 12, pp. 1134-1142 (2005).

Hillis et al., "High Purity Magnesium AM60 Alloy: The Critical Contaminant Limits and the Salt Water Corrosion Performance", SAE Technical Paper Series (1986).

Pawar, S.G., "Influence of Microstructure on the Corrosion Behaviour of Magnesium Alloys", PhD Dissertation, University of Manchester (2011).

Czerwinski, "Magnesium Injection Molding"; Technology & Engineering; Springer Science + Media, LLC, pp. 107-108, (Dec. 2007).

Sigworth et al. "Grain Refinement of Aluminum Castings Alloys" American Foundry Society; Paper 07-67; pp. 5-7 (2007).

Momentive, "Titanium Diborid Powder" condensed product brochure; retrieved from https:/www.momentive.com/WorkArea/DownloadAsset.aspx?id+27489.; p. 1 (2012).

Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).

(56) References Cited

OTHER PUBLICATIONS

Pegeut et al.., "Influence of cold working on the piling corrosion resistance of stainless steel" Corrosion Science, vol. 49, pp. 1933-1948 (2007).
Elemental Charts from chemicalelements.com; retrieved Jul. 27, 2017.
Song et al., "Corrosion Mechanisms of Magnesium Alloys" Advanced Engg Materials, vol. 1, No. 1 (1999).
Zhou et al., "Tensile Mechanical Properties and Strengthening Mechanism of Hybrid Carbon Nanotubes . . ." Journal of Nanomaterials, 2012; 2012:851862 (doi: 10.1155/2012/851862) Figs. 6 and 7.
Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].
AZoNano "Silicon Carbide Nanoparticles-Properties, Applications" http://www.amazon.com/articles.aspx?ArticleD=3396) p. 2, Physical Properties, Thermal Properties (May 9, 2013).
AZoM "Magnesium AZ91D-F Alloy" http://www.amazon.com/articles.aspx?ArticleD=8670) p. 1, Chemical composition; p. 2 Physical Properties (Jul. 31, 2013.
Elasser et al., "Silicon Carbide Benefits and Advantages . . . " Proceedings of the IEEE, 2002; 906(6):969-986 (doi: 10.1109/JPROC.2002.1021562) p. 970, Table 1.
Lan et al., "Microstructure and Microhardness of SiC Nanoparticles . . . " Materials Science and Engineering A; 386:284-290 (2004).
Casati et al., "Metal Matrix Composites Reinforced by Nanoparticles", vol. 4:65-83 (2014).
Machine Translation of CN103898384 (originally cited in Information Disclosure Statement filed Jun. 24, 2020).
Machine Translation of KR 20130023707 (originally cited in Information Disclosure Statement filed Jun. 24, 2020).
Machine Translation of CN103602865 (originally cited in Information Disclosure Statement filed Jun. 24, 2020).
Machine Translation of CN101381829 (originally cited in Information Disclosure Statement filed Jun. 23, 2020).
Machine Translation of CN102518489 (originally cited in Information Disclosure Statement filed Jun. 23, 2020).
Machine Translation of CN 103343271 (originally cited in Information Disclosure Statement filed Jun. 23, 2020).
Machine Translation of CN102796928 (originally cited in Information Disclosure Statement filed Jun. 23, 2020).
Machine Translation of JP2008266734 (originally cited in Information Disclosure Statement filed Jun. 23, 2020).
Machine Translation of JP2012197491 (originally cited in Information Disclosure Statement filed Jun. 23, 2020).
Machine Translation of JP2013019030 (originally cited in Information Disclosure Statement filed Jun. 23, 2020).
Machine Translation of JP2014043601 (originally cited in Information Disclosure Statement filed Jun. 23, 2020).
Hassan et al., "Development of high strength magnesium based composites using elemental nickel particulates as reinforcement", Journal of Materials Science, vol. 37, pp. 2467-2474 (2002).

* cited by examiner

| Sample | angle | loss (cc) |
|---|---|---|
| TAx-100E | 30 | 0.1301 |
| TAx-100E | 60 | 0.1483 |
| TAx-100E | 90 | 0.0442 |
| Gray Cast Iron | 30 | 0.0112 |
| Gray Cast Iron | 60 | 0.0257 |
| Gray Cast Iron | 90 | 0.0162 |
| TA-MMC170130-1 | 30 | 0.0049 |
| TA-MMC170130-1 | 60 | 0.0380 |
| TA-MMC170130-1 | 90 | 0.0323 |

Figure 8

DEGRADABLE METAL MATRIX COMPOSITE

The present invention claims priority on U.S. Patent Ser. No. 62/537,707 filed Jul. 27, 2017, which is incorporated herein by reference.

TECHNICAL FIELD OF THE INVENTION

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In particular, the engineered degradable metal matrix composite of the present invention includes a core material and a degradable binder matrix, and which composite includes the following properties: A) repeating ceramic particle core material of 20-90 vol. %, B) degradable metallic binder/matrix, C) galvanically-active phases formed in situ from a melt and/or added as solid particles, D) degradation rate of 5-800 mg/cm$^2$/hr., or equivalent surface regression rates of 0.05-5 mm/hr. (and all values and ranges therebetween) in selected fluid environments such as, but not limited to, freshwater, brines and/or fracking liquids at a temperature of 35-200° C., and E) hardness exceeding 22 Rockwell C (ASTM E 18-07). The method of manufacturing the composite in accordance with the present invention includes the preparation of a plurality of ceramic particles, with or without galvanically-active materials such as, but not limited to, iron, nickel, copper, titanium, or cobalt, and infiltrating the ceramic particles with a degradable metal such as, but not limited to, magnesium, aluminum, magnesium alloy or aluminum alloy.

BACKGROUND OF THE INVENTION

The preparation of magnesium and aluminum degradable metal compositions, as well as degradable polymer compositions, has resulted in rapid commercialization of interventionless tools, including plugs, balls, valves, retainers, centralizers, and other applications. Generally, these products consist of materials that are engineered to dissolve or to corrode. Dissolving polymers and some powder metallurgy metals have been used in the oil and gas recovery industry.

While these prior art degradable systems have enjoyed success in reducing well completion costs, their ability to withstand deformation and to resist erosion in flowing fluid or to embed in steel casing are not suitable for a number of desired applications. For example, in the production of dissolving frac plugs, ceramic or steel inserts are currently used for gripping surfaces (to set the plug into the steel casing). Requirements for these grips include: a hardness higher than the steel casing; mechanical properties, including compression strength, deformation resistance (to retain a sharp edge); and fracture toughness that must be sufficient to withstand the setting operation where they are embedded slightly into the steel casing. Other applications such as 1) pump down seats currently fabricated from grey cast iron need to be milled out, and 2) frac balls or cones having very small overlaps with the seat (1/16" or less) currently have limited pressure ratings with dissolvable materials due to limited swaging or deformation resistance of current materials.

For applications such as seats and valve components and other sealing surfaces that are subjected to sand or proppant flow, existing magnesium, aluminum, or polymer alloy degradables have insufficient hardness and erosion resistance. In frac ball applications, metallic and polymer degradable balls deform, swage, and shear in such conditions, thereby limiting their pressure rating in small overlap (e.g., below ⅛" overlap) applications.

Sintered and cast products of metal matrix ceramic (MMC) plus metallic composites have been used in structural parts, wear parts, semiconductor substrates, printed circuit boards, high hardness and high precision machining materials (such as cutting tools, dies, bearings), and precision sinter molding materials, among other applications. These materials have found particular use in wear and high temperature highly loaded applications such as bearing sleeves, brake rotors, cutting tools, forming dies, an aerospace parts. Generally, these materials are selected from non-reactive components and are designed to not degrade, and the MMC and the cermets are formulated to resist all forms of corrosion/degradation, including wear and dissimilar metal corrosion.

To overcome the limitations of current degradable materials, a new material is required that has high strength, controlled degradation, and high hardness. Ideally, these high hardness degradable components and materials would also be able to be manufactured by a method that is low cost, scalable, and results in a controlled corrosion rate in a composite or alloy with similar or increased strength compared to traditional engineering alloys such as aluminum, magnesium, and iron and with hardnesses higher than cast iron. Ideally, traditional heat treatments, deformation processing and machining techniques could be used without impacting the dissolution rate and reliability of such components.

SUMMARY OF THE INVENTION

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In one non-limiting embodiment of the invention, the engineered degradable metal matrix composite includes a core material and a degradable binder matrix, and which composite includes the following properties: A) a repeating ceramic particle core material of 20-90 vol. % (and all values and arranges therebetween), B) a degradable metallic binder/matrix of 10-75 vol. % (and all values and arranges therebetween), C) galvanically-active phases formed in-situ from a melt or added as solid particles, D) a degradation rate being controlled to rates of 5-800 mg/cm$^2$/hr. (and all values and ranges therebetween), or equivalent surface regression rates of 0.05-5 mm/hr. (and all values and ranges therebetween) at a temperature of 35-200° C. (and all values and ranges therebetween) in 100-100,000 ppm (and all values and ranges therebetween) water or brines, and E) a hardness exceeding 22 (e.g., 22.01-60 Rockwell C and all values and ranges therebetween). Fluids seen in completion operations and which the composite of the present invention can be used in include 1) freshwater (generally 300-5000 ppm salt content), 2) drilling and completion brines including seawater which are generally chlorides and bromides of potassium, calcium, sodium, cesium, and zinc from about 5000 ppm to as high as 500,000 ppm or more, 3) some formates and acidic fluids, or 4) fluid produced or flowed back from the well formation which can include chlorides and carbonate salts. As can be appreciated, in some cases special fluids can be run in the well formation to cause or trigger the dissolution of the composite of the present invention, or a salt or chemical pills can be added to the fluid to cause or trigger the dissolution of the composite of the present invention. The present inventions also relates to the method of manufacturing the engineered degradable metal matrix composite of the present invention, which method includes the preparation of a plurality of ceramic particles, with or without galvanically-active materials such as, but not limited to, iron, nickel, copper, titanium, or cobalt, and infiltrating the ceramic particles with a degradable metal such as, but not limited to, magnesium or aluminum alloy.

In one non-limiting aspect of the invention, the invention relates to the formation of high hardness, wear-, deformation-, and erosion-resistant metal matrix composite materials that exhibit controlled degradation rates in aqueous media at temperatures that are at least 35° C., and typically about 35-200° C. (and all values and ranges therebetween) conditions. The ability to control the dissolution of a down hole well component in a variety of solutions is very important to the utilization of interventionless drilling, production, and completion tools such as sleeves, frac balls, hydraulic actuated tooling, scrapers, valves, screens, perforators and penetrators, knives, grips/slips, and the like. Reactive materials useful in this invention that dissolve or corrode when exposed to acid, salt, or other wellbore conditions have been proposed for some time. Incorporated by reference are U.S. Pat. Nos. 9,903,010; 9,757,796, and US Publication No. 2015/0239795 which describe techniques for creating and manufacturing dissolvable magnesium alloys through the addition of galvanically-active phases.

To obtain resistance to one type of degradation such as wear, but also to have high susceptibility to another type of corrosion such as aqueous corrosion, a composite containing two distinct phases was found to be required. One phase, being a high hardness phase, is present in large amounts (greater than 30 vol. %, and typically greater than 50 vol. %) of the composite. This high hardness phase provides resistance to wear and erosion and increases the hardness and deformation resistance of the composite. Useful deformation resistance is achieved by a second ceramic phase present in an amount of at least 10 vol. % in the composite. The deformation resistance can be enhanced by use of a higher aspect ratio ceramic phase. Useful hardness increases in the composite can be achieved with greater than 35% volumetric loading of the second ceramic phase, and can be further increased with increasing the loading. By selecting the right materials and controlling their percentages, distribution, and surface areas, novel composites can be fabricated that resist one type of degradation (namely wear or erosion) but are highly susceptible to other types of degradation (aqueous corrosion).

To achieve the desired degradation, galvanically-active phase(s) are required. This is achieved by adding a second phase either as a separate powder blended with the ceramic powder, a coating on the ceramic particles, and/or in situ by solidification or precipitation for the melt or solid solution. For example, when magnesium is selected as a degradable matrix alloy, the galvanically active phase in the magnesium matrix alloy can be formed of 1) iron and/or carbon (graphite) particle additions or coatings on ceramic particles, and/or 2) through the formation of $Mg_2M$ (where M is nickel, copper, or cobalt)-active intermetallics created during solidification from a highly alloyed melt. In terms of effectiveness for increasing corrosion rates, the following ranking can be used: Fe>Ni>Co>Cu, with carbon falling between nickel and copper depending on its structure. In another example, when aluminum or aluminum alloys are selected as the degradable matrix alloy, additions of gallium and/or indium are effective for managing corrosion, and such metals can be added as a coating on the ceramic particles, as intermetallic particles, and/or by adding as a solid solution from an aluminum alloy melt. Additional strengthening phases and solid solution material can be used to accelerate or inhibit corrosion rates. In general, aluminum and magnesium decrease corrosion rates, while zinc is neutral or can enhance corrosion rates. Corrosion rates of 0.02-5 mm/hr. (and all values and ranges therebetween) at a temperature of 35-200° C. for the composite can be achieved in freshwater or brine environments.

When the ceramic content is significant (greater than about 20 vol. %), the ceramic particles begin to block the corrosion process and inhibit the access of the aqueous solution to the degradable metal matrix. A 10-20 times decrease in degradation rates has been observed in a composite that includes 50 vol. % ceramic content. As such, the addition of ceramic content that is greater than about 20 vol. % has been found to result in a non-linear decrease in degradation rates. The decrease is generally more substantial with very fine particles of ceramic material (e.g., less than 100 micron). To compensate for a lower surface area exposed for dissolution due to a large inert loading of ceramic, a much higher dissolution rate in the matrix must be used to generate useful degradation rates. This can be accomplished by substituting more active catalysts (e.g., iron for nickel, nickel for copper), and by reducing the content of inhibiting phases (aluminum or other more cathodic metals). This may be done by moving to a ZK series alloy in magnesium from a WE or AZ series, for example. In general, the degradable matrix alloy and catalyst (galvanically-active phase) is selected to be 5-25 times as active (faster rate) than an equivalent non-composite system.

By selecting the right alloy chemistry and catalyst phase and its content (primarily exposed surface area), degradable MMCs are possible over temperatures ranging from 35-200° C., in low salinity (less than 1000 ppm dissolved solids, and typically 1-5 vol. % dissolved solids, normally KCl, NaCl), and heavy brines ($CaCl_2$, $CaBr_2$, $ZnBr_2$, carbonates, etc.). By reducing galvanically-active phases and adding inhibiting phases, materials having suitable corrosion/degradation rates in acidic media (such as 5 vol. % HCl or formic acid) can also be created.

In summary, the present invention relates to a degradable high hardness composite material that includes 1) plurality of ceramic particles having a hardness greater than 50 HRC and up to 10,000 VHN that forms 20-90 vol. % of the composite, 2) degradable alloy matrix selected from magnesium, aluminum, zinc, or their alloys that forms 10-75 vol. % of the composite, 3) plurality of degradation catalyst particles, zones, and/or regions that are galvanically-active (wherein such particles, zones, and/or regions contain one or more galvanically-active elements such as, but not limited to, iron, nickel, copper, cobalt, silver, gold, gallium, bismuth, lead, carbon or indium metals) and whose content is engineered to control degradation rates of 5-800 $mg/cm^2/hr$. (and all values and ranges therebetween), or equivalent surface regression rates of 0.05-5 mm/hr. (and all values and ranges therebetween) at a temperature of 35-200° C. (and all values and ranges therebetween) in 100-100,000 ppm (and all values and ranges therebetween) water or brines, and 4) ceramic particle content is 25-90 vol. % (and all values and ranges therebetween); to create a composite having a hardness of greater than 22 Rockwell C (ASTM E-18), and typically greater than 30 Rockwell C, and typically up to 70 Rockwell C (and all values and ranges therebetween).

The ceramic or intermetallic particles in the degradable high hardness composite material can be selected from metal carbides, borides, oxides, silicides, or nitrides such as, but not limited to, SiC, $B_4C$, $TiB_2$, TiC, $Al_2O_3$, MgO, SiC, $Si_3N_4$, $ZrO_2$, ZrSiO4, $SiB_6$, SiAlON, WC, or other high hardness ceramic or intermetallic phases. The particles can be hollow or solid.

The ceramic or intermetallic particles in the degradable high hardness composite material can have a particle size of 0.1-1000 microns (and all values and ranges therebetween), and typically 5-100 microns, and may optionally have a broad or multimodal distribution of sizes to increase ceramic content.

Some or all of the ceramic or intermetallic particles in the degradable high hardness composite material can be shards, fragments, preformed or machined shapes, flakes, or other large particles with dimensions of 0.1-4 mm (and all values and ranges therebetween).

The surface coating on the ceramic or intermetallic particles can include nickel, iron, cobalt, titanium, nickel and/or copper to control dissolution and wetting as well as provide some or all of the galvanic activation. The surface coating on the ceramic or intermetallic particles can include magnesium, zinc, aluminum, tin, titanium, nickel, copper and/or other wetting agent to facilitate melt infiltration and/or particle distribution. The surface coating thickness is generally at least 60 nm and typically up to about 100 microns (and all values and ranges therebetween). The surface coating generally constitutes at least 0.1 wt. % of the coated ceramic or intermetallic particle, and typically constitutes up to 15 wt. % of the coated ceramic or intermetallic particle (and all values and ranges therebetween). The ceramic or intermetallic particles can be coated by a variety of coating techniques (e.g., chemical vapor deposition, wurster coating, physical vapor deposition, hydrometallurgy processes and other chemical or physical methods.

The particle surface of the ceramic or intermetallic particles can be modified with metal particles or other techniques to control the spacing of the ceramic particles, such as through the addition of titanium, zirconium, niobium, vanadium, and/or chromium active metal particles. Generally these metal particles constitute about 0.1-15 wt. % (and all values and ranges therebetween) of the coated ceramic or intermetallic particles. It has been found that by coating the ceramic or intermetallic particles with such metals prior to adding the matrix metal, the metal coating facilitates in the building of a metal layer on the ceramic or intermetallic particles to create a boundary between the ceramic or intermetallic particles in the final composite, thereby effectively separating the ceramic or intermetallic particles in the final composite by at least 1.2 and typically at least 2× the coating thickness of the metal coating on the ceramic or intermetallic particles that exist on the ceramic or intermetallic particles prior to the addition of the matrix metal.

The degradable alloy matrix includes magnesium, aluminum, zinc, and their combinations and alloys which forms 10-75 vol. % of the composite, and the composite may optionally contain one or more active metals such as calcium, barium, indium, gallium, lithium, sodium, or potassium. Such active metals, when used, constitute about 0.05-10 wt. % (and all values and ranges therebetween) of the metal matrix material.

The degradation rate of the degradable high hardness composite material can be 0.01-5 mm/hr. (and all values and ranges therebetween) in fresh water or brines at a temperature of 35-200° C. (and all values and ranges therebetween).

The degradation rate of the degradable high hardness composite material can be engineered to be 0.05-5 mm/hr. (and all values and ranges therebetween) in a selected brine composition with a total dissolved solids of 300-300,000 ppm (and all values and ranges therebetween) of chloride, bromide, formate, or carbonate brines at selected temperatures of 35-200° C. (and all values and ranges therebetween).

The degradable high hardness composite material can have a compression strength of greater than 40 ksi, and typically greater than 80 ksi, and more typically greater than 100 ksi.

The degradable high hardness composite material can be fabricated by powder metallurgy, melt infiltration, squeeze casting, or other metallurgical process to create a greater than 92% pore-free structure, and typically greater than 98% pore-free structure.

The degradable high hardness composite material can be deformed and/or heat treated to develop improved mechanical properties, reduce porosity, or to form net shape or near net shape dimensions.

The degradable high hardness composite material can be useful in oil and gas or other subterranean operations, including a seat, seal, ball, sleeve, grip, slip, valve, valve component, spring, retainer, scraper, poppet, penetrator, perforator, shear, blade, insert, or other component requiring wear, erosion, or deformation resistance, edge retention, or high hardness.

The degradable high hardness composite material can be used as a portion of a component or structure, such as a surface coating or cladding, an insert, sleeve, ring, or other limited volume portion of a component or system The degradable high hardness composite material can be applied to a component surface through a cold spray, thermal spray, or plasma spray process The degradable high hardness composite material can be fabricated using pressure-assisted or pressureless infiltration of a bed of ceramic particles, wherein the galvanic catalyst, dopant, or phase is formed in situ (from solidification and precipitation of the melt), ex situ (from addition of particles or coatings in the powder bed or preform) sources, and/or formed in situ prior to or during infiltration or composite preparation.

The degradable high hardness composite material can be fabricated through powder metallurgy processes, including mixing of powders, compacting, and sintering, or alternate isostatic pressing, spark plasma sintering, powder forging, injection molding, or similar processes to produce the desired composite.

The degradable high hardness composite material can have a ceramic phase that contains flakes, platelets, whiskers, or short fibers with an aspect ratio of at least 4:1, and typically 10:1 or more.

These and other advantages of the present invention will become more apparent to those skilled in the art from a review of the figures and the description of the embodiments and claims.

BRIEF DESCRIPTION OF FIGURES

FIG. 1 illustrates a composite formed of ceramic particles 12 in a dissolvable metallic matrix 10. FIG. 2 illustrates a composite formed of ceramic particles 16 in a water degradable matrix 14 with the entire composite surrounded by a protective coating 18 (e.g., degradable polymer material, degradable metal) wherein the coating is triggered to degrade or is removed by some method. FIG. 3 illustrates a composite formed of degradable matrix 20 with ceramic particles 22 and platelet or fiber mechanically reinforcement from flakes, platelets, or fibers 24.

FIG. 5 is a magnesium-coated graphite, consolidated magnesium-germanium part, and microstructure of $Mg_2B_4C$ MMC. FIG. 6 is a magnesium-iron-germanium reactive MMC composite microstructure.

FIG. 7 also illustrates the improvement in erosion resistance of a degradable Mg—$B_4C$ composition of the present invention (Tervalloy™ MMC with 149 micron D50 ceramic particles) as compared to the baseline cast iron materials used today, and also to a non-MMC degradable magnesium alloy.

FIG. 8 is a table that illustrates impingement erosion loss of dissolvable alloys, hardened grey cast iron, and dissolvable magnesium metal matrix composite at different impingement angels.

DETAILED DESCRIPTION OF NON-LIMITING EMBODIMENTS OF THE INVENTION

Figure 1:
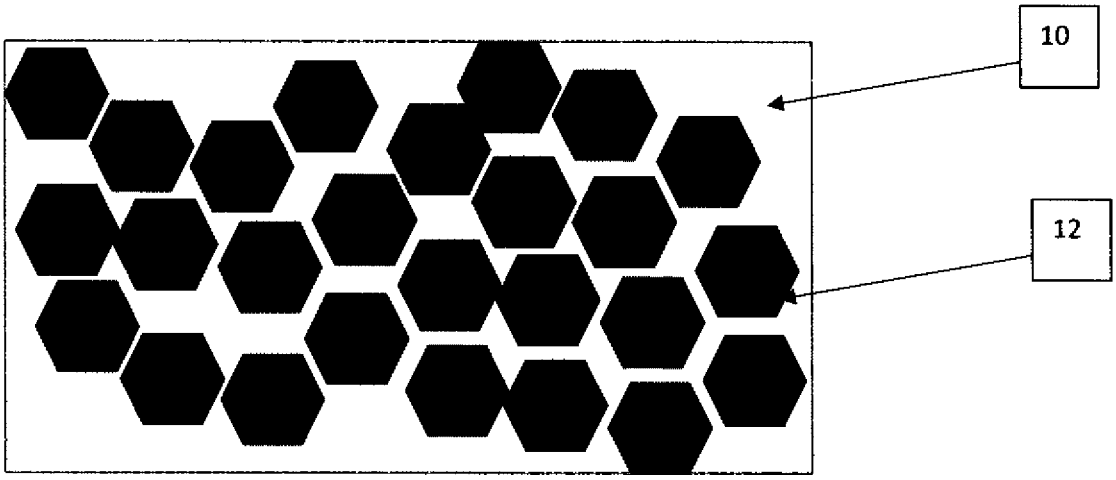
FIGS. 1-3 illustrate various non-limiting degradable metal matrix composite structures in accordance with the present invention. These figures illustrate the ceramic particles dispersed into a dissolvable metal matrix, generally at a concentration of 30-60 vol. %.

The present invention relates to the composition and production of an engineered degradable metal matrix composite that is useful in constructing temporary systems requiring wear resistance, high hardness, and/or high resistance to deformation in water-bearing applications such as, but not limited to, oil and gas completion operations. In one non-limiting embodiment of the invention, the engineered degradable metal matrix composite includes a core material and a degradable binder matrix, and which composite includes the following properties: A) repeating ceramic particle core material of 20-90 vol. % of the composite; B) degradable metallic binder/matrix of 10-75 vol. % of the composite; C) galvanically-active phases formed in situ from a melt and/or added as solid particles that form 0.03-10 vol. % (and all values and ranges therebetween) of the composite; D) degradation rate being controlled to 0.1-5 mm/hr. in selected fluid environments including freshwater and brines at 35-200° C.; and E) hardness of the composite that exceeds 25 Rockwell C. The present inventions also relates to the method of manufacturing the engineered degradable metal matrix composite, which method includes the preparation of a plurality of ceramic particles, with or without galvanically-active materials such as, but not limited to, iron, nickel, copper, or cobalt, and infiltrating the ceramic particles with a degradable metal such as, but not limited to, magnesium or aluminum alloy. The invention also relates to the formation of high hardness, wear-, deformation-, and erosion-resistant metal matrix composite materials that exhibit controlled degradation rates in aqueous media at a temperature of at least 35° C., and typically about 35-200° C. (and all values and ranges therebetween) conditions. The ability to control the dissolution of a down hole well component in a variety of solutions is very important to the utilization of interventionless drilling, production, and completion tools such as sleeves, frac balls, hydraulic actuated tooling, scrapers, valves, screens, perforators and penetrators, knives, grips/slips, and the like.

The invention combines corrodible materials that include highly electronegative metals of magnesium, zinc, and/or aluminum, combined with a high hardness, generally inert phase such as SiC, $B_4C$, WC, $TiB_2$, $Si_3N_4$, TiC, $Al_2O_3$, $ZrO_2$, high carbon ferrochrome, $Cr_2O_3$, chrome carbide, or other high hardness ceramic, and a more electropositive, conductive phase generally selected from copper, nickel, iron, silver, lead, gallium, indium, tin, titanium, and/or carbon and their alloys or compounds. Tool steel, hard amorphous or semi-amorphous steel, and/or stellite alloy-type shards, shavings or particles can offer both galvanic and wear resistance. Other electronegative and electropositive combinations can be envisioned, but are generally less attractive due to cost or toxicity. The more electropositive phase should be able to sustain current, e.g., it should be conductive to drive the galvanic current. The ceramic phase is generally dispersed particles which are fine enough to be able to be easily removed by fluid flow and to not plug devices or form restrictions in a wellbore. It is generally accepted that particles having a size that is less than ⅛" are sufficient for this purpose, although most composites of the present invention utilize much finer particles, generally in the 100 mesh, and very often 200 or 325 mesh sizes, down to 2500 mesh (5 micron and below for increase hardness).

The ceramic or intermetallic, high hardness particles are dispersed in an electronegative metal or metal alloy matrix at concentrations at least 25 vol. %, and typically greater than 50 vol. % of the composite. Very high compressive strength and hardness can be achieved when sufficient ceramic volume has been obtained to limit the effects of the electropositive metal matrix on mechanical properties. This property can be obtained at lower ceramic content when using high aspect ratio particles, such as whiskers, flakes, platelets, or fibers, and substantial deformation resistance can be obtained with higher aspect ratio particles.

Because the generally inert ceramic phase (inert primarily due to low conductivity) inhibits corrosion rates, higher corrosion rate electronegative-electropositive alloy couples are generally used. For example, in a magnesium system, eliminating the addition of aluminum from the alloy (to make the matrix more electronegative), or shifting from copper additions to nickel or even iron (with carbon) additions can be used to increase corrosion rates. For example, using a freshwater or low temperature combination metal matrix (such as Terves FW) instead of a higher temperature brine dissolvable (such as TervAlloy™ TAx-100E and TAx-50E) can be used to sufficiently boost the corrosion rate of a 50 vol. % $B_4C$—Mg containing composite to reach 35 $mg/cm^2/hr.$ at 70-90° C. The addition of carbonyl iron particles to the magnesium alloy matrix can be used to form a useful lower temperature brine, or freshwater dissolvable metal matrix composite. Terves FW, TervAlloy™ TAx-100E and TAx-50E are magnesium or magnesium alloys with 0.05-5 wt. % nickel, and/or 0.5-10 wt. % copper additions.

In one non-limiting embodiment, magnesium alloy includes over 50 wt. % magnesium and one or more metals selected from the group consisting of aluminum, boron, bismuth, zinc, zirconium, and manganese, and optionally 0.05-35 wt. % nickel, copper and/or cobalt. In another non-limiting embodiment, the magnesium alloy includes over 50 wt. % magnesium and one or more metals selected from the group consisting of aluminum in an amount of about 0.5-10 wt. %, zinc in amount of about 0.1-6 wt. %, zirconium in an amount of about 0.01-3 wt. %, manganese in an amount of about 0.15-2 wt. %; boron in amount of about 0.0002-0.04 wt. %, and bismuth in amount of about 0.4-0.7 wt %, and optionally 0.05-35 wt. % nickel, copper and/or cobalt. In another non-limiting embodiment, the magnesium alloy includes over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. % a; boron in amount of about 0.0002-0.04 wt. %, and bismuth in amount of about 0.4-0.7 wt. %, and optionally 0.05-35 wt. % nickel, copper and/or cobalt. In another non-limiting embodiment, the magnesium alloy comprises at least 85 wt. % magnesium; one or more metals selected from the group consisting of 0.5-10 wt. % aluminum, 0.05-6 wt. % zinc, 0.01-3 wt. % zirconium, and 0.15-2 wt. % manganese; and optionally about 0.05-45 wt. % of a secondary metal selected from the group consisting of copper, nickel, cobalt, titanium and iron. In another non-limiting embodiment, the magnesium alloy composite comprises 60-95 wt. % magnesium; 0.01-1 wt. % zirconium; and optionally about 0.05-45 wt. % copper, nickel, cobalt, titanium and/or iron. In another non-limiting embodiment, the magnesium alloy comprises 60-95 wt. % magnesium; 0.5-10 wt. % aluminum; 0.05-6 wt. % zinc; 0.15-2 wt. % manganese; and optionally about 0.05-45 wt. % of copper, nickel, cobalt, titanium and/or iron. In another non-limiting embodiment, the magnesium alloy comprising 60-95 wt. % magnesium; 0.05-6 wt. % zinc; 0.01-1 wt. % zirconium; and optionally about 0.05-45 wt. % of copper, nickel, cobalt, titanium and/or iron. In another non-limiting embodiment, the magnesium alloy comprises over 50 wt. % magnesium; one or more metals selected from the group consisting of 0.5-10 wt. % aluminum, 0.1-2 wt. % zinc, 0.01-1 wt. % zirconium, and 0.15-2 wt. % manganese; and optionally about 0.05-45 wt. % of copper, nickel and/or cobalt. In another non-limiting embodiment, the magnesium alloy comprises over 50 wt. % magnesium; one or more metals selected from the group consisting of 0.1-3 wt. % zinc, 0.01-1 wt. % zirconium, 0.05-1 wt. % manganese, 0.0002-0.04 wt. % boron and 0.4-0.7 wt. % bismuth; and optionally about 0.05-45 wt. % of copper, nickel, and/or cobalt. In another non-limiting embodiment, the magnesium alloy comprises 60-95 wt. % magnesium and 0.01-1 wt. % zirconium. In another non-limiting embodiment, the magnesium alloy comprises over 50 wt. % magnesium and one or more metals selected from the group consisting of aluminum in an amount of about 0.5-10 wt. %, zinc in amount of about 0.1-3 wt. %, zirconium in an amount of about 0.01-1 wt. %, manganese in an amount of about 0.15-2 wt. %, boron in amount of about 0.0002-0.04 wt. %, and bismuth in amount of about 0.4-0.7 wt. %.

Figure 4:
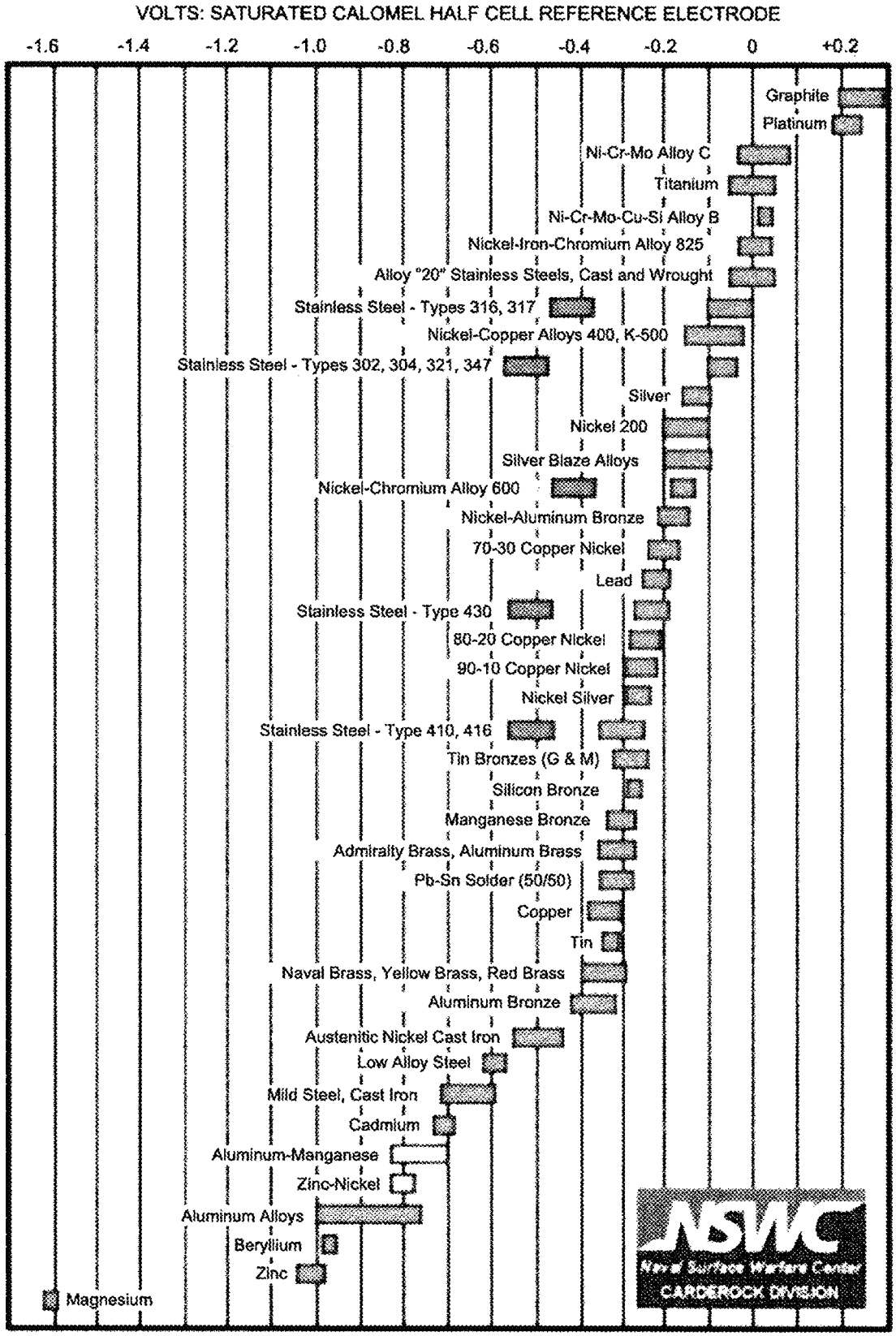
FIG. 4 is a chart illustrating the galvanic series showing electronegative materials. Magnesium is a very electronegative material, and undergoes active corrosion when coupled with a variety of metals. Particularly effective are iron, nickel, copper, and cobalt, as well as $Fe_3Al$ since they do not form insulating oxides under typical conditions and, as such, maintain electrical connectivity with the fluid. Dissolution rates are controlled by the amount and size of these additives, driven by the electrically connected surface area of the positive and negative metals in the galvanic series.

The electropositive driving phase can be added by adding soluble or insoluble electropositive particles to the ceramic powder prior to melt infiltration or mixing into a melt by adding the electropositive material as a coating or cladding to the inert ceramic phase, or by adding as an alloying element that forms a fully liquid phase with the electropositive metal or alloy. In the liquid phase, generally an electropositive metal that forms a eutectic with the electronegative metal and an intermetallic of the electropositive metal can be used. Non-limiting examples of such coatings or claddings are Mg—Ni, Mg—Cu, Mg—Co, and Mg—Ag. FIG. 4 is a chart illustrating the galvanic series showing electronegative materials (magnesium through cadmium, electronegative being more electronegative than steel), and electropositive metals (steel through carbon).

The electropositive driving phase can also be added to electropositive metal powders, along with the ceramic phase, and the dissolvable MMC fabricated from powder metallurgy or spray consolidation techniques such as press and sinter, hot isostatic pressing, spark plasma sintering, powder sinter-forging, direct powder extrusion, thermal spray, cold spray, plasma spray, or other powder consolidation techniques.

For melt infiltration of a ceramic preform or powder bed, techniques that can be used include pressureless infiltration (when the ceramic and electronegative metal wet each other, or when the ceramic has been coated with a wetting phase such as a eutectic forming or other easily wet metal), or pressure-assisted infiltration technique such as squeeze casting, high pressure die casting (into the ceramic preform), vacuum casting, or pressure-assisted casting techniques, among others. Particularly at lower ceramic volumes (25-50 vol. %), the particles can be stir-cast, thixocast, or slurry cast by mixing the ceramic (and electropositive material, if in powder form) and formed in the liquid plus ceramic or semi-solid state. Net shape or near net shape fabrication techniques are preferred due to machining cost of precision grinding of the high hardness materials. Active wetting metals such as titanium, zirconium, vanadium, niobium, silicon, boron, and palladium can be added to the melt system to enhance wetting. Surface wetting coatings, often eutectic liquid formers such as niobium, zirconium, magnesium, aluminum, silicon, and/or bismuth can provide strong wetting ability to enhance pressureless infiltration.

After consolidation, the compact can be further formed by forging, extrusion, or rolling. The compact can also be taken back to an elevated temperature, normally in the semi-solid region between the electropositive alloy liquidus and solidus, and formed using closed die forming, squeeze casting, thixocasting, or other semi-solid forming technique.

The cast or formed part can be machined to close tolerances using grinding or electrode discharge machining (EDM). Diamond, CBN, and other high hardness tools can also be used.

The degradable metal matrix composite can be applied as a coating, such as by cold spray, to a separate part, to impart wear-, erosion-, or deformation-resistance, or to slow initial dissolution rates to give added life. A higher degradation rate core is generally desired. In one embodiment, the MMC can be created by surface alloying the higher degradation rate, or lower hardness core, with the ceramic phase by such techniques as friction stir surfacing, supersonic particle spray, or reactive heat treatments (such as boronizing). Other routes to a dual structured component include overcasting or overmolding, or physical assembly with or without an adhesive or bonding step such as forging, hot pressing, friction welding, or use of adhesives.

After machining, parts may be further coated or modified to control initiation of dissolution or to further increase hardness or ceramic content. Techniques such as cold spray, thermal spray, friction surfacing, powder coating, anodizing, painting, dip coating, e-coating, etc. may be used to add a surface coating or otherwise modify the surface.

The degradable MMCs of the present invention are particularly useful in the construction of downhole tools for oil and gas, geothermal, and in site resource extraction applications. The higher hardness enables tools such as reamers, valve seats, ball seats, and grips to be engineered to be fully degradable, eliminating debris as well as the need to retrieve or drill-out the tools. The degradable MMC is a useful, degradable substitute for hardened cast iron in applications such as plug seats and gripping devices for bridge and frac plugs. The degradable MMC is also useful for the design and production of cement plugs, reamers, scrapers, and other devices.

The deformation resistance of the degradable MMCs allows the construction of higher pressure rating valve and plug systems than non-MMC degradable products. For example, a degradable MMC frac ball can withstand 15,000 psi across a 1/16" seat overlap compared to less than 7,000 psi for a conventional degradable magnesium alloy or polymer ball.

Figure 2:
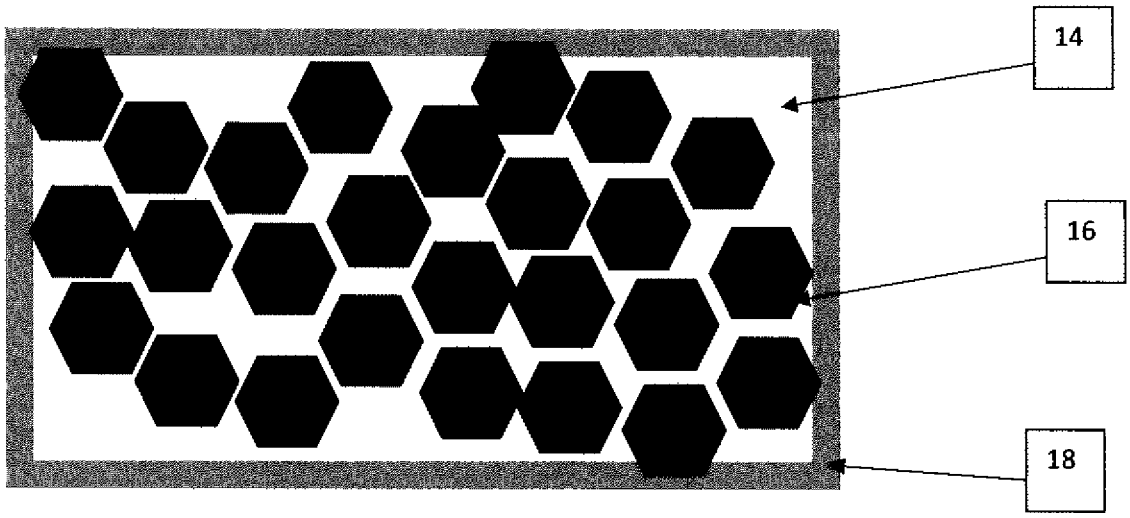
Figure 3:
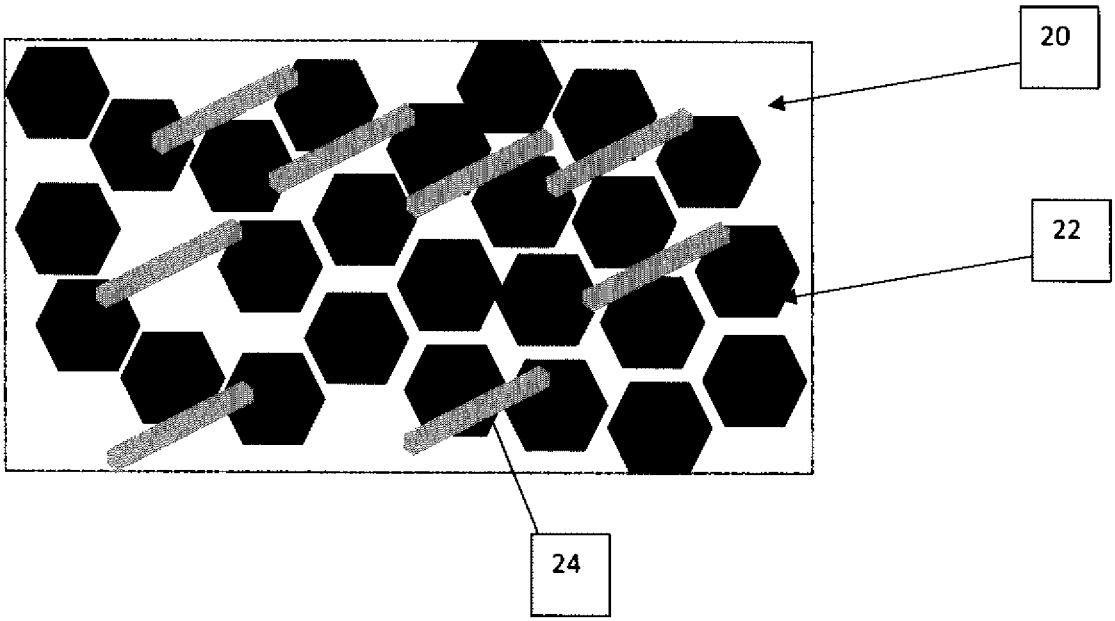

FIGS. 1-3 illustrate various degradable metal matrix composite structures in accordance with the present invention. FIGS. 1-3 illustrate a composite formed of ceramic particles 12 in a dissolvable metallic matrix 10.

The composite material is formed by 1) providing ceramic particles, 2) providing a galvanically-active material such as iron, nickel, copper, titanium, and/or cobalt, 3) combining the ceramic particles and galvanically-active material with molten matrix material such as molten magnesium, molten aluminum, molten magnesium alloy or molten aluminum alloy, and 4) cooling the mixture to form the composite material. The cooled and solid dissolvable metallic matrix generally includes over 50 wt. % magnesium or aluminum. The ceramic material is generally coated with the galvanically-active material prior to adding the motel matrix material; however, this is not required.

The galvanically-active material coating on the ceramic material, when precoated, can be applied by any number of techniques (e.g., vapor deposition, dipping in molten metal, spray coating, dry coated and then heated, sintering, melt coating technique, etc.). Generally, each of the coated ceramic particles are formed of 30-98 wt. % ceramic material (and all values and ranges therebetween), and typically greater than 50 wt. % ceramic material. The thickness of the galvanically-active material coating is generally less than 1 mm, and typically less than 0.5 mm.

After the composite is formed, the ceramic material constitutes about 10-85 wt. % (and all values and arranges therebetween) of the composite, the galvanically-active material constitutes about 0.5-30 wt. % (and all values and arranges therebetween) of the composite, and the molten matrix material constitutes about 10-85 wt. % (and all values and arranges therebetween) of the composite.

The dissolution rate of the composite is at least 5-800 $mg/cm^2/hr.$, or equivalent surface regression rates of 0.05-5 mm/hr. at a temperature of 35-200° C. in 100-100,000 ppm water or brines, and typically at least 45 $mg/cm^2/hr.$ in 3 wt. % KCl water mixture at 90° C., more typically up to 325 $mg/cm^2/hr.$ in 3 wt. % KCl water mixture at 90° C.

FIG. 2 illustrates the composite surrounded by a protective coating 18 (e.g., degradable polymer material, degradable metal). The protective coating can be formulated to dissolve or degrade when exposed to one or more activation or trigger conditions such as, but not limited to, temperature, electromagnetic waves, sound waves, certain chemicals, vibrations, salt content, electrolyte content, magnetism, pressure, electricity, and/or pH. Once the protective coating has sufficiently dissolve or degraded, the composite is then exposed to the surrounding fluid, thus causing the composite to dissolve, corrode, etc. when exposed to certain surrounding conditions. The protective coating can be formed of one or more metal and/or polymer layers. Non-limiting polymer protective coatings that can be used include ethylene-α-olefin copolymer; linear styrene-isoprene-styrene copolymer; ethylene-butadiene copolymer; styrene-butadiene-styrene copolymer; copolymer having styrene endblocks and ethylene-butadiene or ethylene-butene midblocks; copolymer of ethylene and alpha olefin; ethylene-octene copolymer; ethylene-hexene copolymer; ethylene-butene copolymer; ethylene-pentene copolymer; ethylene-butene copolymer; polyvinyl alcohol (PVA); silicone, and/or polyvinyl butyral (PVB). The thickness of the protective coating is generally less than 3 mm, and more typically about 0.0001-1 mm.

FIG. 3 illustrates a composite formed of degradable matrix 20 with ceramic particles 22 and platelet or fiber mechanically-reinforced flakes, platelets, or fibers 24. The platelets or fibers typically have an aspect ratio of at least 4:1, and typically 10:1 or more. The length of the platelets or fibers is generally less than 3 mm, and typically less than 2 mm. The platelets or fibers, when used, are generally formed of boron carbide silicon carbide, and/or graphite; however, other materials can be used.

EXAMPLES

In one embodiment, the reactivity of an electrolytically activated reactive composite of magnesium or zinc and iron with ceramic reinforcements is controlled to produce a dissolution rate of 1-10 mm/day (and all values and ranges therebetween), or 0.5-800 $mg/cm^2/hr.$ (and all values and ranges therebetween) (depending on density) by controlling the relative phase amounts and interfacial surface area of the two galvanically-active phases. In one example, a mechanical mixture of iron or graphite and magnesium is prepared by mechanical milling of magnesium or magnesium alloy powder and 40 vol. % of 30-200 micron iron graphite (and all values and ranges therebetween) graphite or 10 wt. % nickel-coated graphite particles, followed by consolidation using spark plasma sintering or powder forging at a temperature below the magnesium or zinc melting point. The resultant structure has an accelerated rate of reaction due to the high exposed surface area of the iron or graphite cathode phase, but low relative area of the anodic (zinc or magnesium) reactive binder.

Figure 5:
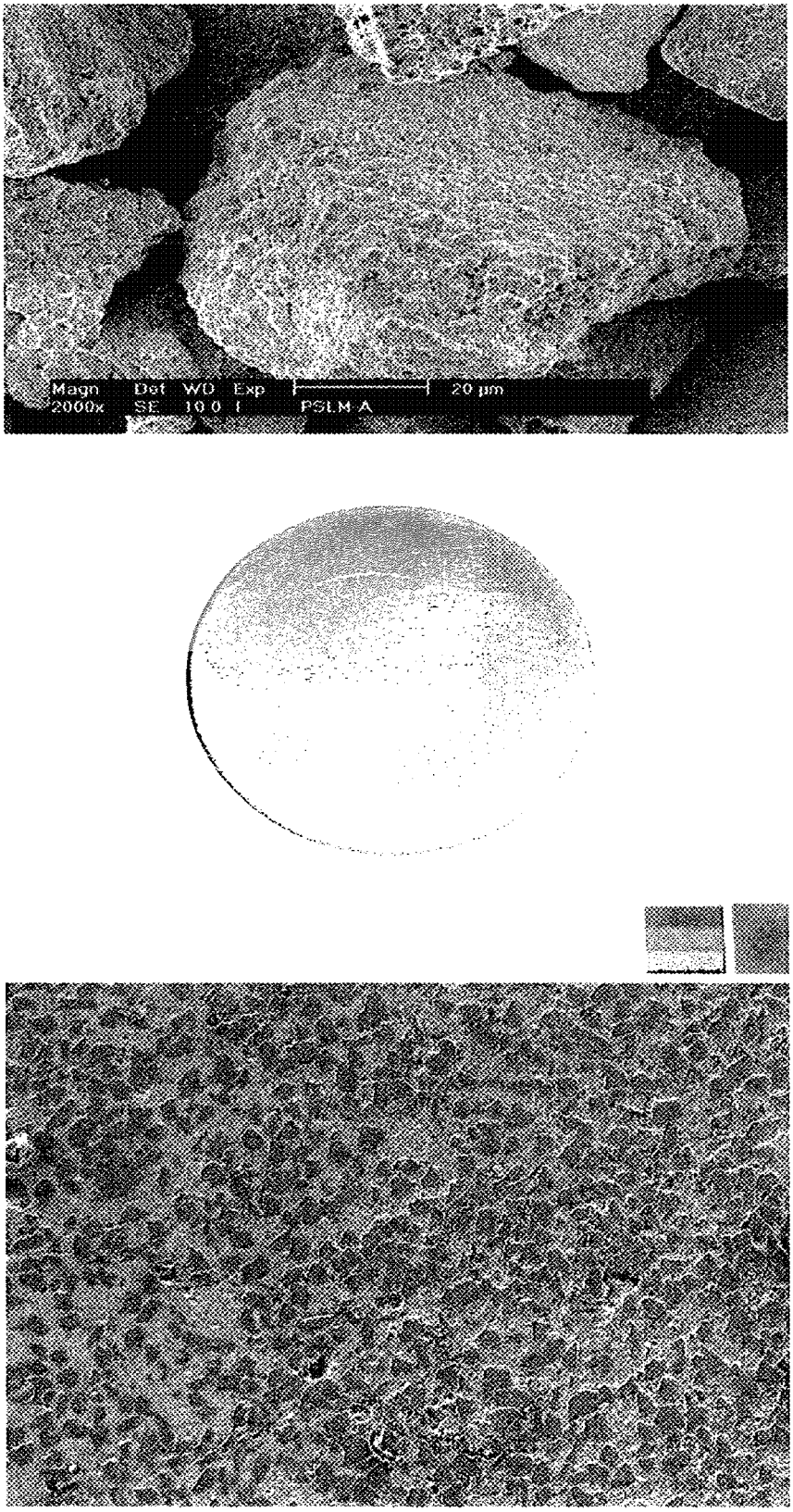
FIGS. 5 and 6 illustrate a representative microstructure for a magnesium-graphite composite that is galvanically active and could be used as a low friction or deformation-resistant structure, but is not generally effective for wear resistance.
Figure 6:
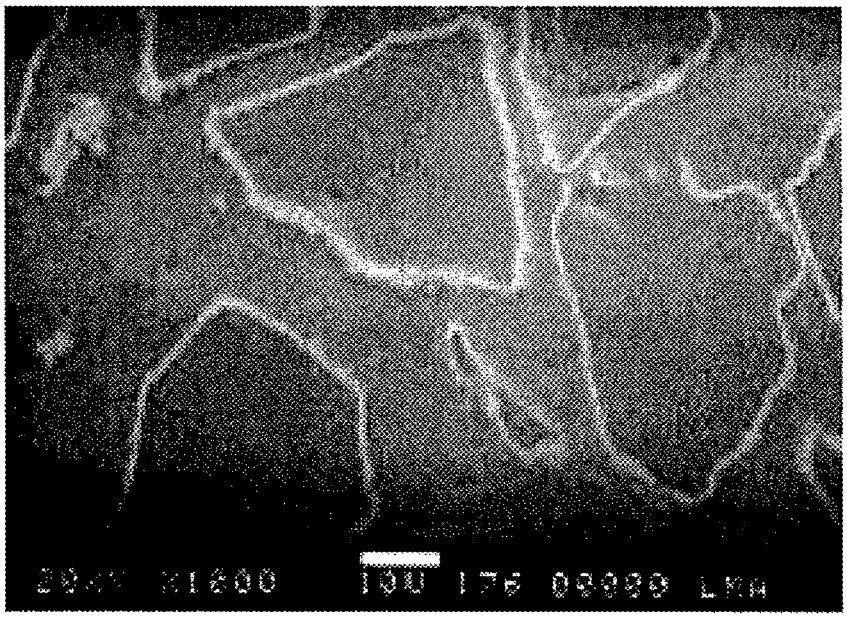
Figure 7:
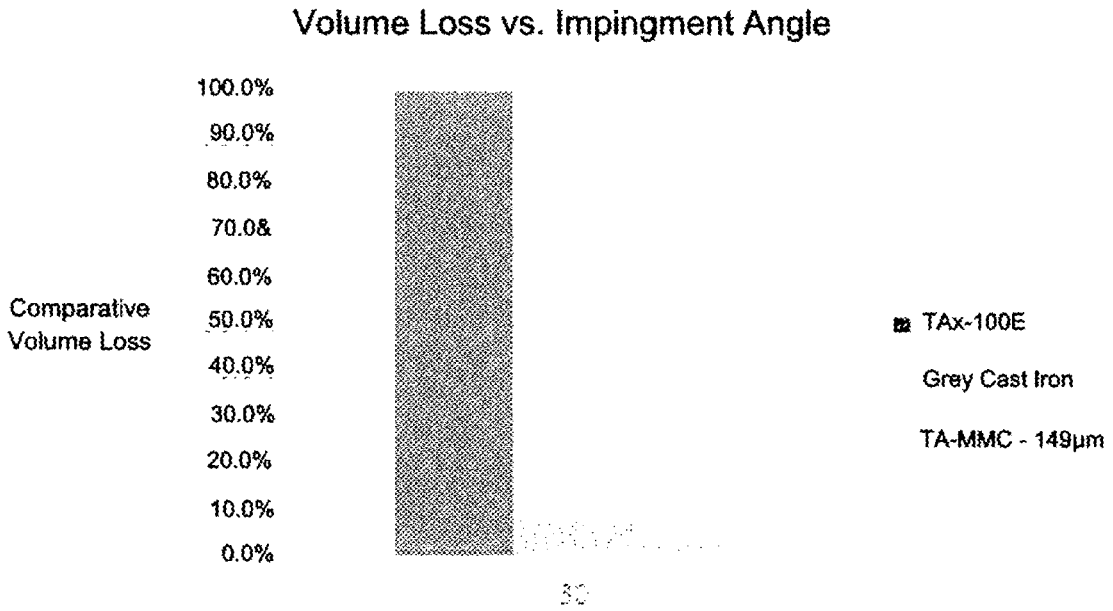
FIG. 7 illustrates the comparative impingement loss at 30° impact angle of a typical seat versus material.

The degradable MMC can be used for powder metallurgical processing. FIGS. 5 and 6 illustrate a representative microstructure for a magnesium-graphite composite.

In general, larger ceramic particles, typically above 40 mesh, including flake, impart great impingement erosion resistance at higher angels, while smaller particles, typically below 200 mesh, provide higher sliding wear resistance. Larger particles can also facilitate gripping (in frac plug grips/slips, to facilitate locking a device to a mating surface), such as when mm-sized crushed carbides are added to a dissolvable matrix. Such embedded metal matrix composites can also be used in reamer-type applications as abrasives, such as by adding larger chunks or even preformed shapes, such as crushed, machined, or formed carbides or tool steel discreet elements.

Example 1

Boron carbide powder with an average particle size of 325 mesh is surface modified by the addition of zinc by blending 200 grams of $B_4C$ powder with 15 grams of zinc powder and heated in a sealed, evacuated container to 700° C. to distribute the zinc to the particle surfaces. The zinc-coated $B_4C$ powder is placed into a graphite crucible and heated to 500° C. with an inert gas cover. In a separate steel crucible, 500 grams of Terves FW low temperature dissolvable degradable magnesium alloy is melted to a temperature of 720° C. The degradable magnesium alloy is poured into the 8-inch deep graphite crucible containing the zinc-coated $B_4C$ particles sufficient to cover the particles by at least two inches and allowed to solidify.

The material had a hardness 52 Rockwell C, and a measured dissolution rate of 35 mg/cm$^2$/hr. in 3 vol. % KCl at 90° C.

Example 2

300 g of 600 mesh boron carbide powder was placed to a depth of 4"×2" diameter by ten-inch deep graphite crucible containing a two inch layer of ¼" steel balls (600 g of steel) covered by a 325 mesh steel screen and heated to 500° C. under inert gas. The graphite crucible was heated inside of a steel tube, which was heated with the crucible. Five pounds of Terves FW degradable magnesium alloy were melted in a steel crucible to a temperature of 730° C. and poured into the graphite crucible sufficient to cover the $B_4C$ and steel balls to reach within two inches of the top of the graphite crucible. The crucible was removed from the furnace and transferred to a 12-ton carver press, where a die was rammed into the crucible forcing the magnesium into and through the powder bed. The crucible was removed from the press and allowed to cool.

The MMC section was separated from the non-MMC material and showed a dissolution rate of 45 gm/cm$^2$/hr. at 90° C. in 3 vol. % KCl solution. The measured hardness was 32 Rockwell C.

Example 3

125 grams of 325 mesh $B_4C$ powder was blended with 4 grams of 100 mesh titanium powder and sintered at 500° C. to form a rigid preform. A 500 gram ingot of TAx-50E dissolvable metal alloy was placed on top of the preform in a graphite crucible. The crucible was placed in the inert gas furnace and heated to 850° C. for 90 minutes to allow for infiltration of the preform. The infiltrated preform had a hardness of 24 Rockwell C.

Example 4

Degradable MMC from Example 3 was machined into a frac ball. A 3" ball (3.000+/−0.002), when tested against a cast iron seat with a 45° seat angle and inner diameter of 2.896", was shown to hold greater than 15,000 psig pressure at room temperature. The degradable magnesium frac ball was machined from a high dissolution rate dissolving alloy having a dissolution rate of greater than 100 mg/cm$^2$/hr. at 90° C. The frac ball was undermachined by 0.010", to 2.980+/−0.002, and the degradable MMC was applied using cold spray application from a powder generated by ball milling 400 grams of standard degradable alloy machine chips with 600 grams 325 mesh of $B_4C$ powder using a centerline Windsor SST cold spray system and nitrogen gas as the carrier gas. The ball was then machined to 3"+/−0.002". The ball held >10,000 psig against a 45° cast iron seat at 2.875" inner diameter. The frac ball was designed to give two hours of operating time, before dissolving rapidly in less than 48 hours at 90° C. in 3% KCl brine solution.

Example 5

Degradable MMC from Example 3 was machined into a frac ball except that TAx-WOE was used instead of TAx-50E. The TAx-100E included trace amounts of iron to form a composite having a hardness of 74 HRB and a dissolution rate of 34 mg/cm$^2$/hr. in 3% vol. % KCl at 90° C. during a six-hour test. 125 grams of 325 mesh $B_4C$ powder was blended with 4 grams of 100 mesh titanium powder and sintered at 500° C. to form a rigid preform. A 500 gram ingot of TAx-100E with 0.1% iron was placed on top of the preform in a steel crucible. The crucible was placed in the inert gas furnace and heated to 850° C. for 90 minutes to allow for infiltration of the preform. The infiltrated preform had a hardness of 74 HRB and a dissolution rate of 34 mg/cm$^2$/hr. in 3% KCl at 90° C. during six hours of brine exposure.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A method for forming a degradable composite comprising:

a. providing a plurality of ceramic or intermetallic particles having a hardness greater than 50 HRC;

b. providing one or more galvanically active elements selected from the group consisting of iron, nickel, copper, cobalt, titanium silver, gold, gallium, bismuth, palladium, carbon, and indium;

c. combining said plurality of ceramic or intermetallic particles and said one or more galvanically-active elements;

d. adding a molten degradable metal matrix to said plurality of ceramic or intermetallic particles and said one or more galvanically-active elements, said molten degradable metal matrix including greater than 50 wt. % magnesium and aluminum;

e. dispersing said plurality of ceramic or intermetallic particles and said one or more galvanically-active elements in said molten degradable metal matrix; and f. cooling said degradable metal matrix to form said degradable composite, said degradable composite having a surface regression rate of at least 0.02 mm/hr. at 35° C. to 200° C. in 100-100,000 ppm freshwater or brine, said degradable composite having a hardness of greater than 22 Rockwell C, said composite including at least 10 vol. % degradable metal matrix, at least 0.03 vol. % galvanically-active elements, and at least 20 vol. % ceramic or intermetallic particles.

2. The method as defined in claim 1, wherein said plurality of ceramic or intermetallic particles are coated with said one or more galvanically-active elements prior to said addition of said molten degradable metal matrix to said plurality of ceramic or intermetallic particles and said one or more galvanically-active elements.

3. The method as defined in claim 1, wherein the ceramic or intermetallic particles include one or more types of particles selected from metal carbides, borides, oxides, silicides, or nitrides such as $B_4C$, $TiB_2$, TiC, $Al_2O_3$, MgO, SiC, $Si_3N_4$, $ZrO_2$, $SiB_6$, SiAlON, or WC.

4. The method as defined in claim 1, wherein the ceramic or intermetallic particles have a particle size of 0.1 microns to 1000 microns.

5. The method as defined in claim 1, wherein at least a portion of the ceramic or intermetallic particles are shards, fragments, preformed or machined shapes, or flakes with a maximum dimension of 0.1-4 mm.

6. The method as defined in claim 1, wherein said galvanically-active elements include one or more elements selected from the group consisting of nickel, iron, cobalt, titanium, and copper.

7. The method as defined in claim 1, wherein said composite is greater than a 92% pore-free structure.

8. The method as defined in claim 1, wherein said composite is deformed and/or heat treated to improve mechanical properties of said composite, reduce porosity of said composite, and/or form net shape or near net shape dimensions of said composite.

9. The method as defined in claim 1, wherein the composite formed into a degradable structure is useful in oil and gas or other subterranean operations, said degradable structure including a seat, seal, ball, frac ball, cone, wedge, insert for a slip, sleeve, frac seat, grip, slip, valve, valve component, spring, retainer, scraper, poppet, penetrator, perforator, shear, ring, blade, insert, or other component requiring wear-, erosion-, or deformation-resistance, edge retention, or high hardness.

10. The method as defined in claim 1, wherein said composite is a surface coating or cladding for a component.

11. A method for forming a degradable composite, said method comprises:

a. providing a plurality of ceramic or intermetallic particles having a hardness greater than 50 HRC;

b. providing one or more galvanically active elements selected from the group consisting of calcium, barium, lithium, sodium, potassium, iron, nickel, copper, cobalt, titanium silver, gold, gallium, bismuth, lead, palladium, carbon, and indium;

c. combining said plurality of ceramic or intermetallic particles and said one or more galvanically-active elements, said ceramic or intermetallic particles having a particle size of 0.1-1000 microns;

d. adding a molten degradable metal matrix to said plurality of ceramic or intermetallic particles and said one or more galvanically-active elements, said molten degradable metal matrix selected from i) a magnesium alloy including greater than 50 wt. % magnesium, and ii) an aluminum alloy including greater than 50 wt. % aluminum;

e. dispersing said plurality of ceramic or intermetallic particles and said one or more galvanically-active elements in said molten degradable metal matrix; and f. cooling said degradable metal matrix to form said degradable composite, said degradable composite having a degradation rate of at least 5 $mg/cm^2/hr.$ at 35° C. in 100-100,000 ppm freshwater or brine, said degradable composite having a hardness of greater than 22 Rockwell C, said composite including at least 10 vol. % degradable metal matrix, at least 0.03 vol. % galvanically-active elements, and at least 10 vol. % ceramic or intermetallic particles.

12. The method as defined in claim 11, wherein said ceramic or intermetallic particles include one or more materials selected from the group consisting of $B_4C$, $TiB_2$, TiC, $Al_2O_3$, MgO, SiC, $Si_3N_4$, $ZrO_2$, $ZrSiO_4$, $SiB_6$, SiAlON, WC, carbon ferrochrome, $Cr_2O_3$, and chrome carbide.

13. The method as defined in claim 11, wherein said degradable composite has a hardness of greater than 30 Rockwell C.

14. The method as defined in claim 11, wherein said ceramic or intermetallic particles are surface coated with a metal prior to being mixed with said molten degradable metal matrix, said metal including one or more materials selected from the group consisting of nickel, zirconium, niobium, vanadium, chromium, iron, cobalt, titanium, copper, magnesium, zinc, aluminum, tin, and titanium, said coating having a thickness of 60 nm to 100 microns.

15. The method as defined in claim 11, wherein said degradable metal matrix is a magnesium alloy including greater than 50 wt. % magnesium, said magnesium alloy including one or more metal additive selected from the group consisting of nickel, copper, aluminum, boron, bismuth, zinc, zirconium, cobalt, manganese, titanium, and iron.

16. The method as defined in claim 11, said method further includes the step of coating said degradable composite with a protective coating, said protective coating less than 3 mm, said protective coating including a polymer layer.

17. The method as defined in claim 11, said method further includes the step of adding flakes, fibers, or platelets to said mixture of said molten degradable metal matrix, said ceramic or intermetallic particles, and said galvanically-active elements, said flakes fibers or platelets having an aspect ratio of at least 4:1, a length of said flakes, fibers, or platelets up to 4 mm, said flakes, fibers, or platelets including one or more materials selected from the group consisting of boron carbide, silicon carbide, and graphite.

18. The method as defined in claim 11, wherein a compression strength of said degradable composite is greater than 40 ksi.

19. The method as defined in claim 11, said method further includes the step of deforming and/or heat treating said degradable composite to develop improved mechanical properties, reduce porosity, or to form net shape or near net shape dimensions.

20. The method as defined in claim 19, wherein said degradable composite is formed partially or fully into a structure useful in oil and gas or other subterranean operations, said structure including a seat, seal, ball, frac ball, cone, wedge, insert for a slip, sleeve, valve, frac seat, sleeve, grip, slip, valve, valve component, spring, retainer, scraper, poppet, penetrator, perforator, shear, blade, and insert.

* * * * *